United States Patent [19]

Fasching et al.

[11] 4,453,949

[45] Jun. 12, 1984

[54] ASH BED LEVEL CONTROL SYSTEM FOR A FIXED-BED COAL GASIFIER

[75] Inventors: George E. Fasching, Morgantown; John R. Rotunda, Fairmont, both of W. Va.

[73] Assignee: The United States of America as represented by the United States Department of Energy, Washington, D.C.

[21] Appl. No.: 473,308

[22] Filed: Mar. 8, 1983

[51] Int. Cl.[3] ..... C10J 3/42

[52] U.S. Cl. ..... 48/77; 48/66; 48/85.2; 48/87; 48/DIG. 10; 364/500; 422/110

[58] Field of Search ..... 48/77, 66, 68, 85.2, 48/87, DIG. 10, 203; 414/209; 422/110, 116, 105, 106; 110/185, 190, 192; 364/500

[56] References Cited

U.S. PATENT DOCUMENTS 4,309,194 1/1982 Salvada et al. ..... 48/77

FOREIGN PATENT DOCUMENTS 3046249 12/1981 Fed. Rep. of Germany ..... 48/203

*Primary Examiner*—Peter F. Kratz

*Attorney, Agent, or Firm*—David E. Breeden; Stephen D. Hamel; Michael F. Esposito

[57] ABSTRACT

An ash level control system is provided which incorporates an ash level meter to automatically control the ash bed level of a coal gasifier at a selected level. The ash level signal from the ash level meter is updated during each cycle that a bed stirrer travels up and down through the extent of the ash bed level. The ash level signal is derived from temperature measurements made by thermocouples carried by the stirrer as it passes through the ash bed and into the fire zone immediately above the ash bed. The level signal is compared with selected threshold level signal to determine if the ash level is above or below the selected level once each stirrer cycle. A first counter is either incremented or decremented accordingly. The registered count of the first counter is preset in a down counter once each cycle and the preset count is counted down at a selected clock rate. A grate drive is activated to rotate a grate assembly supporting the ash bed for a period equal to the count down period to maintain the selected ash bed level.

In order to avoid grate binding, the controller provides a short base operating duration time each stirrer cycle. If the ash bed level drops below a selected low level or exceeds a selected high level, means are provided to notify the operator.

7 Claims, 2 Drawing Figures

ASH BED LEVEL CONTROL SYSTEM FOR A FIXED-BED COAL GASIFIER

BACKGROUND OF THE INVENTION

This invention relates generally to automatic control systems for a coal gasifier and more specifically to an automatic ash level control system for a fixed-bed coal gasifier.

In operation of a fixed-bed coal gasifier, it is necessary to maintain the ash level at the prescribed elevation. If the level drops too low, grate burnout is likely to occur. If the level rises above a nominal optimum height, then the devolatilization, gasification, and fire zones become shortened with subsequent loss of conversion efficiency and over temperature at the gasifier outlet. To control the ash level, the grate is rotated at a speed/duty rate such as to maintain the nominal ash level, but control is dependent upon the availability of a dependable and relatively accurate means of measuring the ash level.

It has been the practice to provide thermocouples in the arm of the bed stirrer to monitor the temperature profile of the gasifier bed. The motion of the stirrer is such that a helical scan of the bed temperature is produced. Since the stirrer both rotates and reciprocates, the signals from the thermocouples are transmitted by means of an EM/FM telemetry system. The bed temperature signal is used as a means for determining the ash level through the development of an ash level meter as described in U.S. patent application Ser. No. 434,021, filed Oct. 12, 1982, for an "Ash Level Meter For A Fixed-Bed Coal Gasifier" by George E. Fasching. It has been the practice to manually control the ash level through the operators constant monitoring of the ash level meter output. However, manual grate control, even though operated with considerable care and dedication, has been found to be unsatisfactory causing erratic gasifier performance and grate burnout.

Thus, there is a need for a system to automatically control the ash bed level in a coal gasifier.

SUMMARY OF THE INVENTION

In view of the above need, it is an object of this invention to provide an ash bed level control system for automatically controlling the ash bed level of a coal gasifier.

Additional objects, advantages, and novel features of the invention will be set forth in part, in the description which follows, and in part will become apparent to those skilled in the art upon examination of the following or may be learned by practice of the invention.

In summary, the ash bed level control system of this invention is for use in a fixed-bed coal gasifier having a bed stirrer which reciprocally travels at a selected cycle rate through at least the ash zone of the bed and a movable grate disposed to support the bed. The grate is operated by a grate drive for removing ash from the bed when operated by the grate drive. An ash level measuring means is provided for generating an ash level signal (L) whose amplitude is proportional to the ash level above the grate. Means are provided for detecting the stirrer vertical position and generating a stirrer vertical position signal (SVP) at an output which is proportional to the stirrer vertical position. The amplitude of the L signal is compared with a reference threshold signal selected for a desired ash level in a comparator circuit. When the L signal exceeds the reference threshold during a stirrer cycle, the output of the comparator changes states and an up/down counter is incremented at a selected point in the stirrer cycle, as determined from the SVP signal. If the L signal does not exceed the reference threshold, the output of the comparator does not change states and the up/down counter is decremented. Subsequently, during the cycle, the registered count of the up/down counter is loaded into a down counter under control of a logic control circuit and the down counter is counted down by the application of clock pulses to the count input. This counting period controls the on time of the grate drive during each stirrer cycle and thus controls the ash level.

Control circuits are provided to maintain a basic grate operation time during each cycle even though the ash level is low in order to prevent grate binding. If the ash level falls below a predetermined low-low level, grate operation is inhibited and an alarm is activated.

If the ash level exceeds a selected maximum level, circuitry is provided to activate an alarm indicating manual control is necessary.

BRIEF DESCRIPTION OF THE DRAWINGS

The accompanying drawings, which are incorporated in and form a part of the specification, illustrate an embodiment of the present invention, and together with the description, serve to explain the principles of the invention.

DETAILED DESCRIPTION

Figure 1:
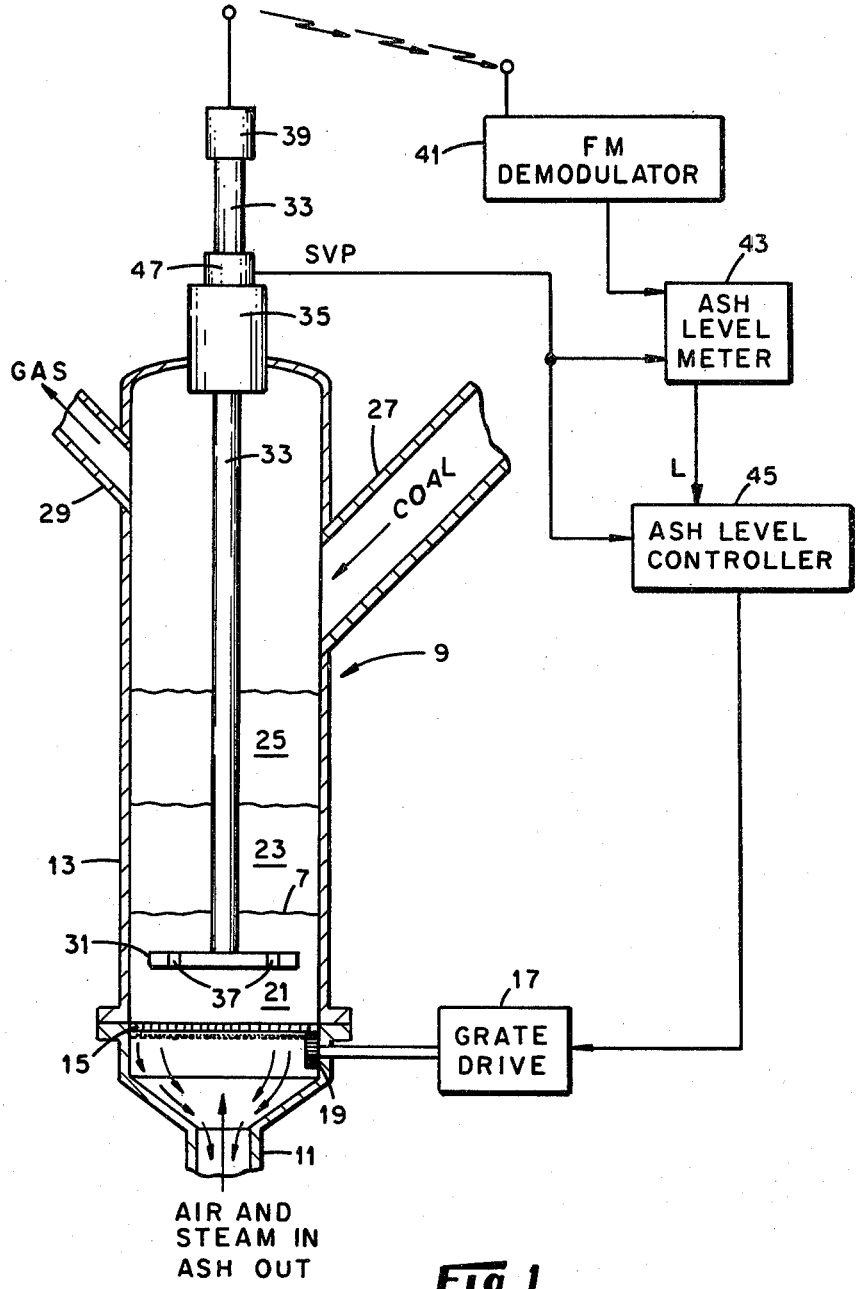
FIG. 1 is a schematic diagram of an ash level control system for a fixed-bed coal gasifier according to the present invention.

Referring now to FIG. 1, there is shown an ash level control system for controlling the ash level 7 of a fixed-bed coal gasifier 9. The gasifier 9 is of conventional design, wherein air mixed with steam to support combustion is introduced through a bottom part 11 of a cylindrical containment housing 13. A grate 15 supports the bed above the inlet 11 and is rotated by means of a grate drive 17 through an appropriate gear and shaft arrangement 19. As the grate is rotated, ash is ground and agitated from the bed and exits through the bottom part 11. The bed includes an ash zone 21 immediately above the grate, followed by a combustion zone 23 and a layer of coal 25 above the combustion zone. Coal is fed into the gasifier through a conduit 27 and the product gas is taken off through a gas exit conduit 29.

The bed is continuously agitated by means of a stirrer 31 attached to a stirrer post 33. A stirrer drive mechanism 35 engages the post 33 at the top of the gasifier to both rotate and reciprocate the stirrer 31. The stirrer travels from just above the grate 15 to a point normally above the combustion zone 23 and back with a travel cycle of about 15 minutes. The stirrer is rotated at a rate of about 0.5 revolutions/ minute while traveling up and down in the 15 minute cycle. The bed temperature profile in the ash zone approximates the relatively cold (200° to 300° F.) steam/air mixture blown up into the bed past the grate 15 at the bottom to that of the fire zone (1,000° to 2,000° F.) with a thin interface of large temperature gradient between the two zones. Thermocouples 37 carried by the stirrer 31 are used to measure the bed temperature as the stirrer moves through the bed.

Leads to the thermocouples extend up through the stirrer post 33 to an FM transmitter 39 carried atop the stirrer post. Because the stirrer both rotates and reciprocates, the signals are transmitted by an FM/FM telemetry system. The FM modulated signal is detected by an FM receiver and demodulator 41. The output of the demodulator 41 is connected to one input of an ash level meter 43. This signal varies between −5 volt and +5 volts corresponding to a temperature range of 0° to 2,500° F. This signal is used to generate an ash level signal L whose amplitude is proportional to the ash level 7 in the gasifier 9. Details of an ash level meter which may be used in this application may be had by referring to the above-referenced U.S. patent application.

The ash level signal (L) is a signal whose amplitude varies between 1 and 5 volts corresponding to a 0 to 30-inch span of the ash zone upper boundary level 7. This signal together with a stirrer vertical position signal (SVP) is the inputs for an ash level controller 45 which is the subject of this invention. The output of the controller 45 is fed to the grate drive 17 to control the operating time of the grate during each stirrer cycle, as will be explained.

To measure the position of the stirrer, a position transducer 47, such as a cable operated, spring-return potentiometer, is mounted atop the stirrer drive and engages the post 33. The transducer 47 provides a stirrer vertical position signal (SVP) to an input of the meter 43 and controller 45. The SVP signal varies between 1 and 5 volts for a range of stirrer elevation of just above the grate to a level 72" above the grate, the extent of vertical travel of the stirrer 31. Normally, the range of vertical used is about 36 inches (starting just above the grate) for a 42-inch fixed-bed gasifier as illustrated herein.

Figure 2:
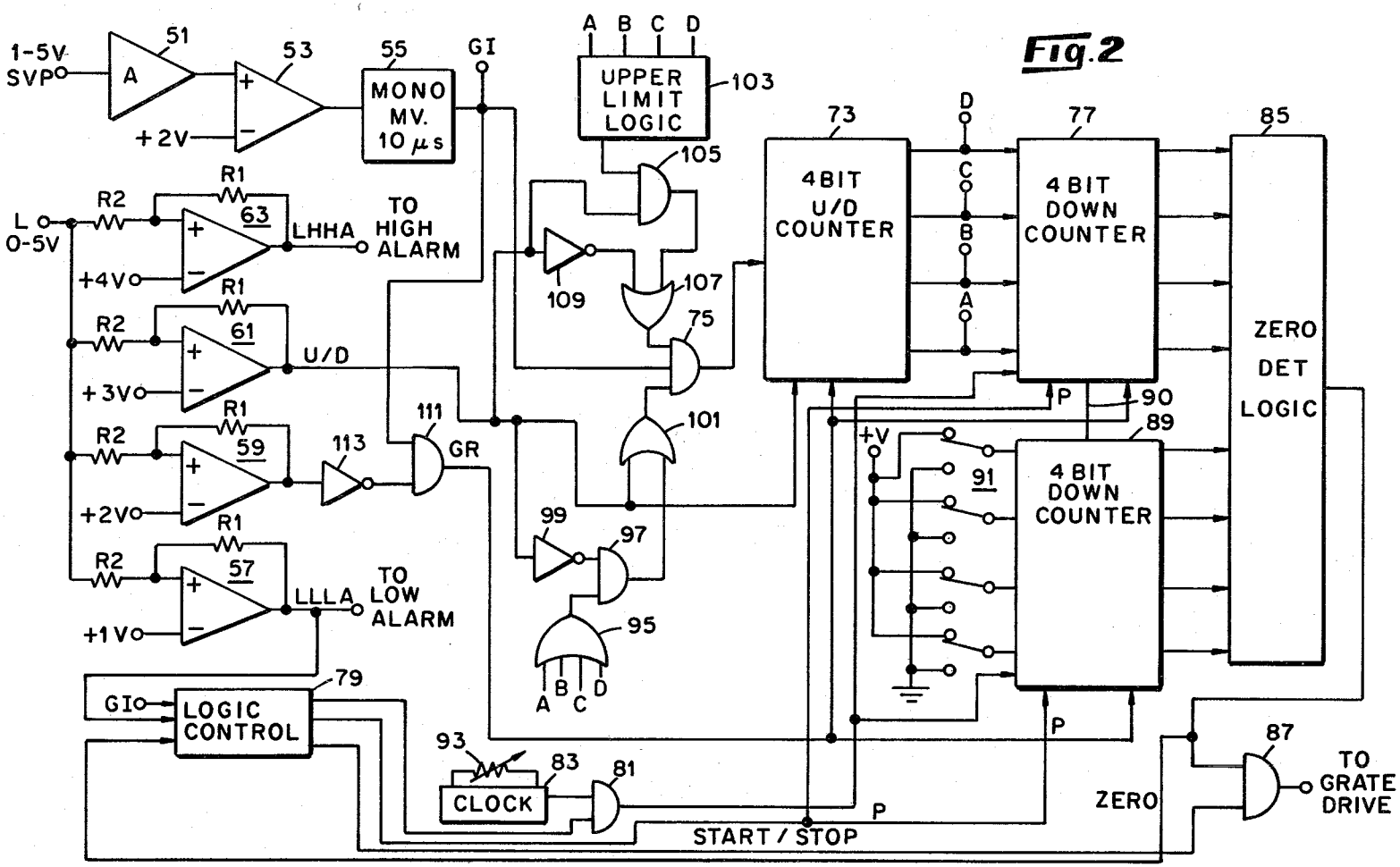
FIG. 2 is a schematic block diagram of the ash level controller circuit of FIG. 1.

Referring now to FIG. 2, it will be seen that the SVP signal is applied through a buffer amplifier 51 to the input of a comparator 53. The threshold of the comparator is determined by a reference voltage of typically 2 volts that is applied to the reference input of the comparator 53. This reference voltage corresponds to a stirrer position of about 28 inches above the grate, which is approximately the position of the stirrer just above the desired level 7 of about 18 inches. When the SVP signal exceeds the reference signal the output of comparator 53 changes states from a low level to a high level. This change of state triggers a 10 microsecond monostable multivibrator (MV) 55 connected to the output of comparator 53. The MV 55 generates a positive 10 microsecond pulse (GI) which is used to initiate the grate operation once each stirrer cycle.

To establish the grate operation time for each stirrer cycle, the ash level meter signal (L) is applied to the inputs of four comparators 57, 59, 61 and 63. The reference threshold of each of the comparators 57–63 is set so that their outputs change states at L signal levels corresponding to ash levels of 6 inches (low-low level), 12 inches (low level), 18 inches (high level) and 24 inches (high-high level), respectively above the grate 15. Each comparator (57–63) comprises an operational amplifier provided with a positive feedback circuit consisting of a resistor R1 connected between the output and the non-inverting (+) input and a series input resistor R2 connected to the + terminal. The reference threshold voltage is applied to the inverting input (−) of the amplifier. The positive feedback provides voltage hysteresis which produces a switching deadband. The width of the hysteresis loop is determined by the ratio of the feedback resistors (R1/R2). The purpose of the deadband is to provide a more positive comparator switching action through the threshold, thereby minimizing the possibility of multiple switchings caused by noise embedded in the SVP signal.

The controller operates to maintain the ash level at a high level (18 inches) by means of incrementing/decrementing action of the grate run period during each 15 minute stirrer cycle as indicated by the output state of the high comparator 61. The output of the comparator 61 is connected to the up/down control input of an up/down 4-bit counter 73. The registered count of counter 73 is either incremented or decremented one count each stirrer cycle by the application of the GI pulse from MV 55 through an AND gate 75 to the count input of counter 73 depending upon the state of the U/D line from comparator 61. If the reference threshold of comparator 61 is not exceeded by the level signal L during a cycle, the U/D line is low and counter 73 is decremented. If the reference threshold is exceeded, the counter 73 is incremented. The four stages of counter 73 are connected to corresponding stage inputs of a 4-bit presetable, down counter 77. A preset pulse (P) is applied to the preset input of counter 77 from a logic control circuit 79 which is triggered by the application of the GI pulse to the input of a logic circuit 79 once each cycle. This pulse presets the counter 77 to the count registered in counter 73.

Following the preset operation, the logic control circuit 79 enables an AND gate 81 by placing a "high" signal on an output line connected to one input of AND gate 81. This enables gate 81 to pass clock pulses from a clock 83 having an output connected to the second input of gate 81. These clock pulses are applied to the count input of counter 77 by connecting the output of gate 81 to the count input of counter 77.

Outputs from the four stages of counter 77 are connected to a corresponding set of four inputs of a conventional zero count detection device 85. When the counter 77 is counted down to zero by the application of the clock pulses, the output of logic circuit 85 goes low from a high condition which persists as long as a count greater than zero is sensed at the inputs. The output line (ZERO) is connected to an input of control circuit 79 and one input of an AND gate 87. Further, a START/STOP output line from controller 79 is connected to a second input of AND gate 87 which is set high to enable gate 87 following each GI pulse applied to controller 79 and is returned to the low level when the ZERO line input to controller 79 goes low indicating detection of a zero count. This holds the output of AND gate 87 low, turning the grate drive "off". The output of AND gate 87 is the output of the controller 45 connected to the input of the grate drive 17, as shown in FIG. 1. The grate drive 17 may also include conventional relay circuits to start and stop a grate drive motor, for example, in response to the high and low states, respectively, of the gate 87 output. The grate drive may also be provided with a switching means for manual takeover of the grate operation under abnormal operation conditions, such as a low-low ash level alarm condition sensed by comparator circuit 57 or a high-high ash level condition sensed by the comparator 63. In either case the operator is notified by suitable alarms connected to the outputs of comparators 57 and 63, respectively.

If the comparator 57 reference threshold is not exceeded, the LLLA signal is low which activates a low-low level alarm and sets the START/STOP line from controller 79 low to override the controller and stop the grate drive. If the comparator 63 reference threshold is exceeded, the LHHA signal goes high which activates the high-high level alarm.

In order to prevent grate binding, the automatic controller provides a short, fixed base operating time for the grate drive during each stirrer cycle. This is provided by a second presetable, 4-bit binary down counter 89. The bit stage inputs are connected to a bank of base rate selection switches 91 which are set to a high (+V) or low (ground) state to provide the required binary count input which is preset in counter 89 simultaneous with the presetting of counter 77 by the P pulse from logic controller 79. The counters 77 and 89 may be connected in cascade to provide essentially an eight-bit counter. For example, the counters may be what is referred to in the art as "ripple counters" in which the clock pulse from gate 81 is connected to each cascaded stage. A borrow line 90 is connected between the stages to form the 8-bit counting capacity. Each time counter 89 is counted down through zero count it resets to 16 counts and activates the borrow line 90 to reduce the count in counter 77 by 1 count. The counting stages of counter 89 are also connected to the zero count detection device 85 so that both counters 77 and 89 must be counted to zero to cause the ZERO output line to go low, stopping the grate drive. Thus, if there are zero counts preset in counter 77 during a stirrer cycle, the preset count in counter 89 (up to 16 counts) controls the base grate operating time. The clock 83 pulse frequency may be varied in a conventional manner, as by a potentiometer 93 connected in the oscillator circuit, to vary the grate operation period relative to the registered count.

To prevent the UP/DN counter 73 from counting down through zero, a gating circuit is provided to inhibit the GI pulse at gate 75. A four input OR gate 95 is connected to the four stage outputs A, B, C and D of counter 73. If all four outputs are low, indicating a zero count, the OR gate 95 output is low. This output is applied to one input of an AND gate 97 which has another connected to the U/D line from comparator 61 through an inverter 99. The output of gate 97 is connected to one input of an OR gate 101 which has a second input connected to the U/D line and its output connected to one input of AND gate 75. If the A, B, C and D lines are low, causing the output gate 95 to go low indicating a zero count registered by counter 73, and the level signal L drops below the reference threshold of comparator 61 causing the U/D line to go low, to indicate that counter 73 is to decremented, the output of AND gate 97 is low due to the low out of OR gate 95. Thus, both inputs to OR gate 101 will be low and the output will go low to inhibit the passage of the GI count pulse through gate 75 to the counter 73. As long as the registered count in counter 73 is above zero, the OR gate output will be high causing at least one input of OR gate 101 to be high if the U/D line is in either the high or low condition. A low condition on the U/D line enables both inputs to AND gate 97, due to the inverter 99, and thus the output of gate 97 is high.

In a similar manner a maximum grate run time may be selected by means of an upper limit logic circuit 103 and a gating arrangement connected to another input of AND gate 75. The logic circuit 103 may be a 4-bit, binary comparison circuit in which a binary number is selected corresponding to the registered count for a maximum grate operation period. This number is compared with the A, B, C and D outputs of counter 73 and when the values compare the output of logic circuit 103 goes low. This output is connected to one input of an AND gate 105 which has a second input connected to the U/D line. The output of AND gate 105 is connected to one input of an OR gate 107 and the U/D line is connected through an inverter 109 the input of OR gate 107. Thus, if the output of logic circuit 103 is high, indicating a maximum count and, therefore, the maximum achievable grate on-time has been reached, and U/D line is high, indicating the count is to be incremented, the output of OR gate 107 will be low. This inhibits gate 75 from passing the GI count pulse to the counter 73. Under normal conditions the output of OR gate 107 remains high due to the output of inverter 109 being high for a decrementing of the counter 73 or both inputs of AND gate 105 being high for an incrementing of the counter 73.

If the level signal falls below the reference threshold of comparator 59, indicating a low level, the counters 73, 77 and 89 are reset to zero by the application of the GI pulse through an AND gate 111 as a grate reset (GR). The output of comparator 59 is connected through an inverter 113 to one input of gate 111 while the output of MV 55 is connected to the other input. This action resets the counters and returns operation to the base time rate as controlled by counter 89.

In operation for a stirrer cycle time of about 15 minutes and a controlled ash level 7 of about 18 inches above the grate 15, the ash level signal L is calibrated to be between 0–5 volts corresponding to 0–30 inch ash level. The reference thresholds for comparators 57, 59, 61 and 63 are set at +1 volt, +2 volts, +3 volts and +4 volts corresponding to 6, 12, 18 and 24 inch levels, respectively. The base grate operating time each cycle is set by selecting a base count input to counter 89 by the arrangement of the switches 91 and the clock 83 output pulse rate. For example, if a 30 second base operating rate is required to prevent grate binding, the counter 89 may be preset to 16 counts and a clock pulse rate of 0.5 pulses/second is selected.

When the system is first activated, the grate will be operated for 30 seconds during each stirrer cycle until the L signal exceeds the reference threshold of the high level (18 inches) comparator 61. This sets the U/D line high, causing the counter 77 to be incremented by one count each cycle that the reference threshold is exceeded. It has been determined that a grate operating time per cycle of 6–8 minutes for a 15 minute stirrer cycle will provide the required regulated 18 inch ash level. Thus, at a 0.5 pulse/second clock rate the required total counts set in the cascaded counters 77 and 89 for this period will be from 180 to 240 counts. It will be obvious that if different times are required the clock rate and base rate count preset, selected by switches 91, may be changed or additional counters may be cascaded to provide the correct grate operating periods.

Once the base rate and clock frequency is selected, a control sequence from logic circuit 79 is initialed by the GI pulse. By providing a +2 volts reference voltage to comparator 53, the GI pulse will coincide with a stirrer position just above the desired ash level range. Since the SVP signal varies between 1–5 volts for elevation of 0 to 72 inches above the grate, the 2 volt reference corresponds to an elevation of about 28 inches. This allows the counters to be updated on the present stirrer cycle before a control sequence is initiated each cycle.

Following a short delay after each GI pulse, controller 79 sends a short pulse (P) to preset the down counters 77 and 89 to the output of U/D counter 73 and the base rate select switches 91, respectively. After another short delay, gate 81 is enabled to provide clock pulses to counters 77 and 89 which count the preset count down as explained above and simultaneously sets the START/STOP line high to turn on the grate drive 17. The grate drive remains on until the count in both the counters 77 and 89 clock down to zero count as sensed by the zero detection logic circuit 85. Upon reaching the zero count as signified by a high on the ZERO line, the controller 79 places a low on the START/STOP line and disables the clock pulse gate 81. The low on the START/STOP line also disables gate 87 to stop the grate drive until the control sequence is again initiated by the GI pulse during the next stirrer cycle.

During each cycle, the counter 73 is incremented or decremented depending upon whether the ash level signal exceeds or falls below the reference threshold of comparator 61, thereby either increasing or decreasing the grate operating period of each cycle to lower or raise the ash level as required.

The foregoing description of a preferred embodiment of the invention has been presented for purposes of illustration and description. It is not intended to be exhaustive or to limit the invention to the precise form disclosed, and obviously many modifications and variations are possible in light of the above teachings. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In combination with a fixed-bed coal gasifier having a bed stirrer which reciprocally travels at a selected cycle rate through at least the ash zone of said bed and a movable grate disposed to support said bed and operated by a grate drive for removing ash from said bed, an ash level control system, comprising:

an ash level measuring means for generating an ash level signal proportional to the ash level above said grate;

means for detecting the vertical position of said stirrer and generating a stirrer vertical position signal at an output thereof proportional to the stirrer vertical position;

a comparator circuit means for comparing said ash level signal with a first reference threshold signal level and generating an output signal which changes from a first state to a second state when said reference threshold is exceeded;

a trigger signal generating means responsive to said stirrer vertical position signal for generating a trigger pulse during each stirrer cycle at a preselected stirrer position;

an up/down counter means for registering a decrement in the stored count in response to said trigger pulses occuring when said output of said comparator means is in said first state and registering an increment in the stored count in response to said trigger pulses occuring when said output of said comparator means is in said second state;

a presettable down counter means coupled to said up/down counter for registering a preset count corresponding to said stored count of said up/down counter means when a preset pulse is applied to a preset input thereof and subsequently counting the registered count down in response to clock pulses applied to a count input thereof;

a clock pulse generator for generating clock pulses at a selected frequency;

a control means operable in response to each of said trigger pulses for generating and applying said preset pulse to said down counter and subsequently applying said clock pulses from said clock pulse generator to said count input of said down counter so that said counter is counted down to zero count during each stirrer cycle; and means for activating said grate drive to operate said grate once each stirrer cycle for the period required to count said preset count of said down counter to zero.

2. The combination as set forth in claim 1 wherein said down counter means includes means for presetting a selected base preset count during each stirrer cycle so that said grate is operated at least a preselected base period during each stirrer cycle.

3. The combination as set forth in claim 2 wherein said comparator means further includes means for comparing said ash level signal with a second reference threshold signal level below said first reference threshold signal level corresponding to a predetermined low ash level and generating a reset signal in response to said trigger signal when said ash level signal falls below said second reference threshold signal level, said reset signal being applied to corresponding reset inputs of said counter means so that said down counter is reset to said base present count when said ash level signal falls below said second reference threshold signal level.

4. The combination as set forth in claim 3 further including a gating circuit means responsive to the output of said up/down counter means for preventing said up/down counter means from counting down through zero count when said ash level signal falls below said first reference threshold signal level.

5. The combination as set forth in claim 4 further including means responsive to the output of said up/down counter means for limiting the up counts registered by said up/down counter means to a preselected maximum level when said ash level signal exceeds said first reference threshold signal level.

6. The combination as set forth in claim 5 further including means responsive to said ash level signal for inhibiting the operation of said grate drive means and generating a low ash level alarm signal when said ash level signal falls below a preselected low signal level below said second reference signal threshold level to indicate an abnormal low ash level in said gasifier.

7. The combination as set forth in claim 6 further including means responsive to said ash level signal for generating a high ash level alarm signal when said ash level signal exceeds a preselected high signal level above said first reference threshold signal level to indicate an abnormal high ash level in said gasifier.

* * * * *